US006626702B2

(12) United States Patent
Kurimoto et al.

(10) Patent No.: US 6,626,702 B2
(45) Date of Patent: Sep. 30, 2003

(54) CONNECTOR WITH MOVABLE LOCKING RETAINER AND TEST METHOD USING THE SAME

(75) Inventors: Naoya Kurimoto, Yokkaichi (JP); Kazuhiko Nimura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/014,366

(22) Filed: Dec. 14, 2001

(65) Prior Publication Data

US 2002/0086580 A1 Jul. 4, 2002

(30) Foreign Application Priority Data

Dec. 28, 2000 (JP) ..... 2000-401686

(51) Int. Cl.[7] ..... H01R 13/40; H01R 13/514

(52) U.S. Cl. ..... 439/595; 439/752

(58) Field of Search ..... 439/595, 594, 439/598, 744, 752, 271

(56) References Cited

U.S. PATENT DOCUMENTS 6,123,574 A 9/2000 Matsuda et al. ..... 439/488
6,358,102 B1 * 3/2002 Fukamachi ..... 439/752
6,461,177 B1 * 10/2002 Saka et al. ..... 439/157
2002/0197913 A1 * 12/2002 Mase et al. ..... 439/752

FOREIGN PATENT DOCUMENTS

JP 11-45761 2/1999

* cited by examiner

*Primary Examiner*—Chandrika Prasad
(74) *Attorney, Agent, or Firm*—Greenblum & Bernstein, P.L.C.

(57) ABSTRACT

A horizontally inserted retainer is mounted in a housing, and can be moved between a temporary locked position which allows insertion and removal of female terminal fittings and a final locked position which retains the female terminal fittings in the housing. A front stop plate with insertion openings is provided on the retainer, and the insertion openings are offset from housing chambers containing female terminal fittings when the retainer is in the temporary locked position. A continuity test is carried out by inserting a test probe through the insertion openings when the retainer is in the temporary locked position. Since only a portion of the front rim of the female terminal fitting is accessible through the insertion opening, the test probe contacts the portion of the front rim and does not enter deeply into the female terminal fitting. Therefore, elastic connecting pieces of the female terminal fittings are not excessively bent, and the female terminal fittings are not damaged, during the continuity test.

16 Claims, 13 Drawing Sheets

CONNECTOR WITH MOVABLE LOCKING RETAINER AND TEST METHOD USING THE SAME

BACKGROUND OF THE INVENTION

1. Field of the Invention

The present invention relates to a connector and a continuity test method for the connector.

2. Description of the Related Art

In a female connector, female terminal fittings with tubular form connecting parts, which are configured for fitting with tabs of corresponding male terminal fittings, are inserted in chambers provided in the female connector housing. The female terminal fittings are designed to be retained by a retainer inserted from a side face of the chambers. A test probe is designed to contact each of the female terminal fittings in order to test whether each of the female side terminal fittings is properly inserted in a chamber.

Specifically, the test probe is inserted through terminal insertion openings for insertion of male terminal fitting tabs on the front of the chambers, and inserted in the connecting portions of the female terminal fittings. The test probe contacts elastic connecting pieces provided on the connecting portions. Japanese Patent Publication (Kokai) Hei No. 11-45761 discloses a continuity test carried out with such a probe.

The above-mentioned probe may be mounted on a jig for performing the test and may be driven for insertion and retraction by a lever operation. The penetration stroke of the probe is predetermined, but when the probe inadvertently penetrates further, the elastic connecting pieces maybe excessively bent and deformed causing degradation thereof.

The present invention was developed to address the above-mentioned problems, and a purpose is to prevent damage to the female terminal fittings during a continuity test.

SUMMARY OF THE INVENTION

In order to address the problems described above, a connector of the present invention for accommodation of female terminal fittings having tubular portions configured to receive tabs of corresponding male terminal fittings is provided which includes a connector housing and a retainer. The connector housing includes a plurality of chambers therein, each chamber configured to receive a female terminal fitting inserted therein from a rear end thereof. The retainer is configured to be inserted in a front end of the connector housing, and includes locking portions configured to engage female terminal fittings inserted in the chambers for retaining the female terminal fittings therein. The retainer also includes a front stop plate configured to cover front ends of the chambers. The front stop plate is configured to be locked in a test position in which openings in the front stop plate are aligned with portions of front edges of the female terminal fittings inserted in the chambers, so that a test probe inserted through a front stop plate opening will contact a portion of a front edge of a female terminal fitting.

Further, in the connector according to the present invention the locking portions of the retainer do not engage the female terminal fittings inserted in the chambers when the front stop plate is locked in the test position.

Also, in the connector according to the present invention the front stop plate is configured to be locked in a final position in which the openings in the front stop plate are aligned with the chambers so that a tab of a male terminal fitting inserted through a front stop plate opening will be received in the tubular portion of a female terminal fitting inserted in a chamber. Further, the locking portions of the retainer engage the female terminal fittings inserted in the chambers when the front stop plate is locked in the final position.

In another aspect of the present invention, a method for using a connector and testing for proper insertion of female terminal fittings in chambers of a connector housing is provided, in which the female terminal fittings have tubular portions configured to receive tabs of corresponding male terminal fittings therein. The method includes inserting a retainer in a front end of the connector housing so that a front stop plate of the retainer covers front ends of the connector housing chambers. The front stop plate is locked in a test position in which openings in the front stop plate are aligned with portions of front edges of the female terminal fittings inserted in the connector housing chambers. Thereafter, a test probe is inserted through a front stop plate opening so that the test probe contacts a portion of a front edge of a female terminal fitting inserted in a connector housing chamber while being prevented from entering the tubular portion of the female terminal fitting.

The testing method according to the present invention may further include moving the front stop plate from the test position to a final position in which the openings in the front stop plate are aligned with the connector housing chambers, and inserting a tab of a male terminal fitting through a front stop plate opening so that the tab of the male terminal fitting enters the tubular portion of a female terminal fitting inserted in a connector housing chamber.

The retainer may include locking portions configured to engage female terminal fittings inserted in the connector housing chambers to retain the female terminal fittings therein. The locking portions do not engage the female terminal fittings while the front stop plate is locked in the test position. The method of the present invention may further include locking the female terminal fittings in the connector housing chambers by engaging the female terminal fittings with the locking portions of the retainer when the front stop plate is moved to the final position.

The method of the present invention may further include inserting female terminal fittings into the chambers of the connector housing and removing female terminal fittings from the chambers of the connector housing after the retainer has been inserted in the front end of the connector housing, and while the front stop plate is locked in the test position.

In another aspect of the present invention, a connector is provided which includes a connector housing, a retainer and locking members. The connector housing includes a chamber passing therethrough. The retainer is configured to be inserted in a front end of the connector housing, and includes a front stop plate having an insertion opening passing therethrough. The locking members lock the front stop plate in both a temporary position in which the insertion opening of the front stop plate is partially offset from the chamber of the connector housing, and a final position in which the insertion opening of the front stop plate is aligned with the chamber of the connector housing. The connector housing may include a plurality of chambers passing therethrough, and the front stop plate may include a plurality of insertion openings passing therethrough.

Further, in the connector according to the present invention the retainer includes locking portions configured to engage terminal fittings inserted in the chambers of the connector housing to retain the terminal fittings therein. Further still, the locking portions of the retainer engage terminal fittings in the chambers of the connector housing when the front stop plate is locked in the final position. The locking portions of the retainer do not engage terminal fittings in the chambers of the connector housing when the front stop plate is locked in the temporary position.

Also, in the connector according to the present invention the chambers of the connector housing are configured to receive female terminal fittings inserted therein. The insertion openings of the front stop plate are configured to permit passage of a test probe therethrough for contacting a female terminal fitting when the front stop plate is locked in the temporary position. The insertion openings of the front stop plate are also configured to permit passage of a male terminal fitting therethrough for connection with a female terminal fitting when the front stop plate is locked in the final position.

BRIEF DESCRIPTION OF THE DRAWINGS

The above and other objects, features and advantages of the present invention will be made apparent from the following description of the preferred embodiments, given as non-limiting examples, with reference to the accompanying drawings in which.

DETAILED DESCRIPTION OF THE PREFERRED EMBODIMENTS

The present invention is described below with reference to the embodiment shown in FIG. 1 to FIG. 21.

Figure 1:
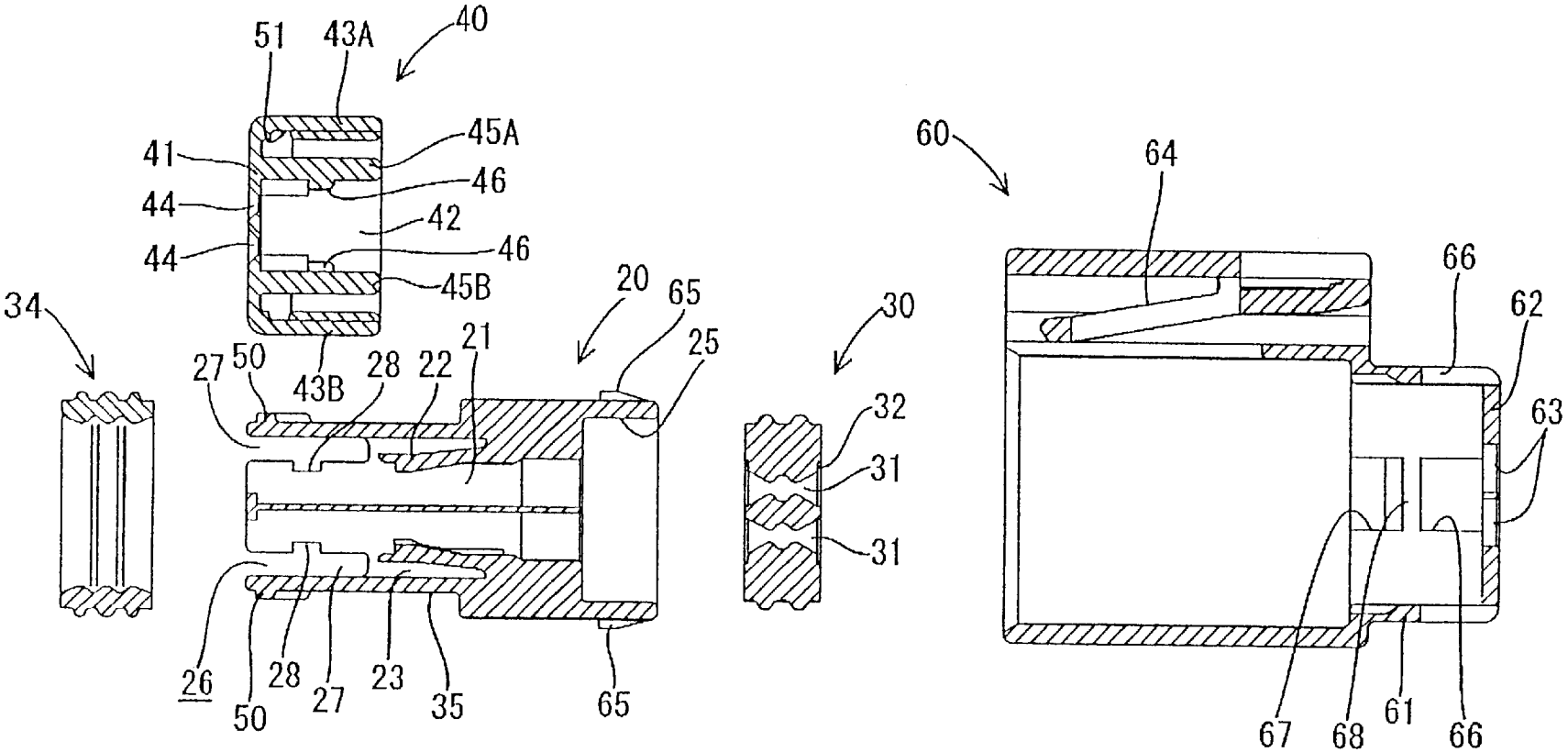
FIG. 1 is an exploded sectional view of an embodiment of the present invention.
Figure 2:
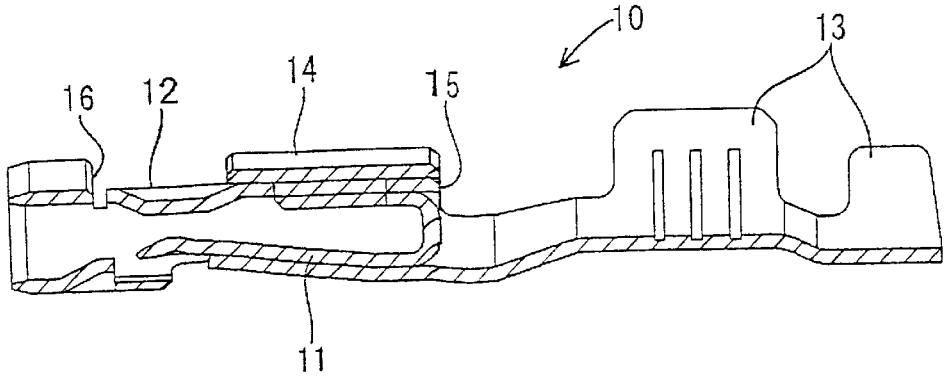
FIG. 2 is a sectional side view of a female terminal fitting.

As shown in FIG. 1, the waterproof female connector includes a housing 20, a hood 60, a packing 34 which seals a gap between a corresponding male connector, a collective stopper 30, and a retainer 40 which secondarily locks the female terminal fittings 10 mounted in the housing 20.

As shown in FIGS. 2, 3, 16 and 19, the female terminal fittings 10 have substantially square tubular connecting portions 12 which are configured to receive tab connecting portions of corresponding male terminal fittings therein. Elastic connecting pieces 11 elastically grip tab connecting portions received in the tubular connecting portions 12. Female terminal fittings 10 are fixed on the terminal ends of electric wires W by crimping barrels 13 which are provided at the rear end thereof. The stabilizers 14 which protrude upwardly are formed at one side of the upper face of the connecting portions 12, and the lances 22 of housing 20 can be hooked on the barb portions 15 of the rear rim at the same level. Further, the hooked groove 16 on which the projection 46 of the retainer 40 can be fitted is formed at the side edge position at the same level by being opened at the side face.

The housing 20 may be formed of any suitable material, such as a synthetic resin, formed in a block form which is slightly larger at the rear end as shown in FIG. 4 to FIG. 9. The chambers 21 store the above-mentioned female terminal fittings 10 and open on the front and rear faces of housing 20 in two levels which each contain four chambers. The chambers 21 are symmetrically formed facing in opposite directions on the top and bottom levels. The lances 22 are respectively provided in a condition in which they can be elastically bent toward the upper face in the upper level of chambers 21, and toward the bottom face in the lower level of chambers 21, facing toward the bending space 23 as shown in FIG. 1.

Figure 10:
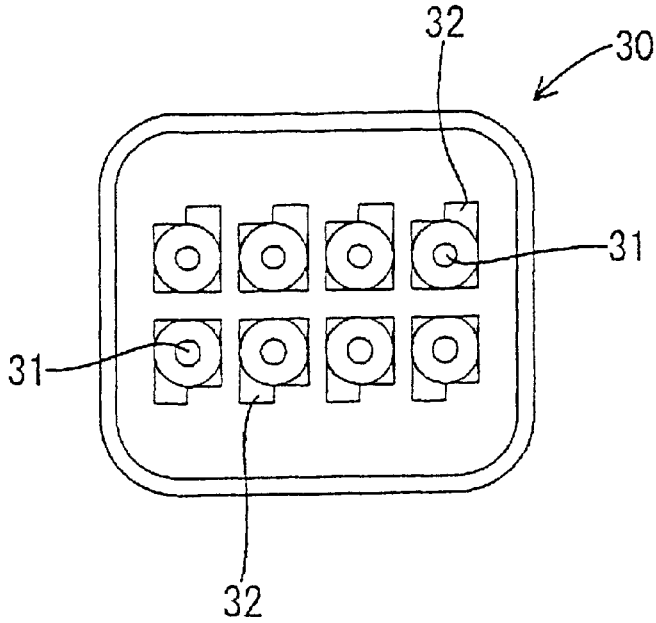
FIG. 10 is a front view of a stopper of the present invention.

The collective stopper 30, which may be formed of any suitable material, such as rubber, is configured to be mounted in the rear face of the housing 20. As shown in FIG. 10, the stopper 30 is formed in a substantially square form which can cover the inlets of all of the chambers 21. The electric wire insertion holes 31 through which the electric wires W can pass are formed in the stopper 30 in correspondence with the arrangement of the chambers 21.

Further, the marks 32 which match in location with the stabilizers 14 provided on the female terminal fittings 10, are formed at the entrance rims of the electric wire insertion holes 31. As shown in FIG. 10, the marks 32 are at the right upper position for the electric wire insertion holes 31 of the upper level, and at the left lower position for the electric wire insertion holes 31 of the lower level. Further, the marks 32 are provided on both sides of stopper 30, and are formed so that the stopper 30 may be mounted facing either the inside or the outside.

Further, the stopper storing recess 25 which snugly fits with and fixes the stopper 30 is formed at the rear face of the housing 20 adjacent the rear inlets of the respective chambers 21.

Figure 11:
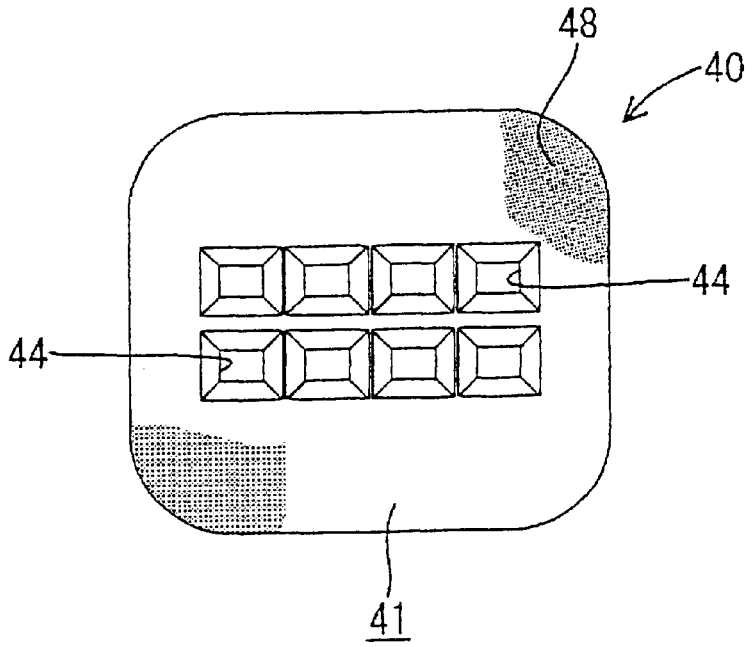
FIG. 11 is a front view of a retainer of the present invention.
Figure 12:
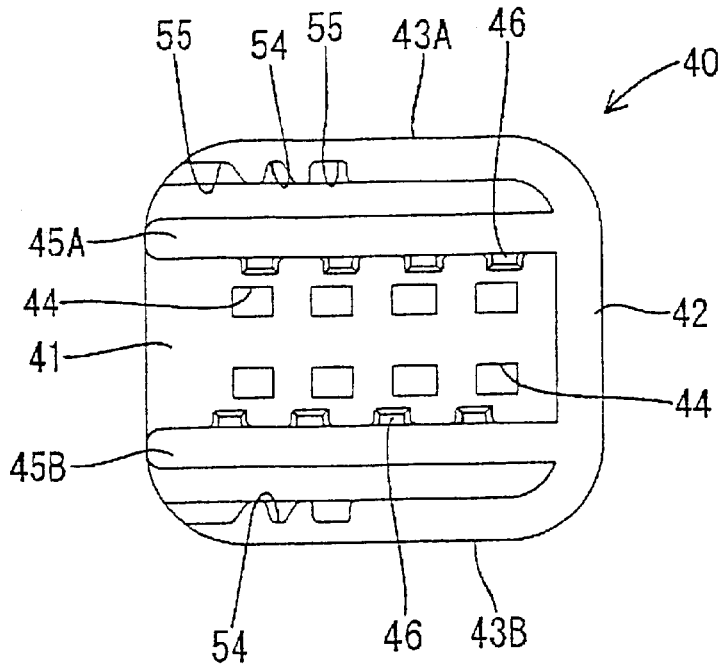
FIG. 12 is a rear view of the retainer of FIG. 11.
Figure 13:
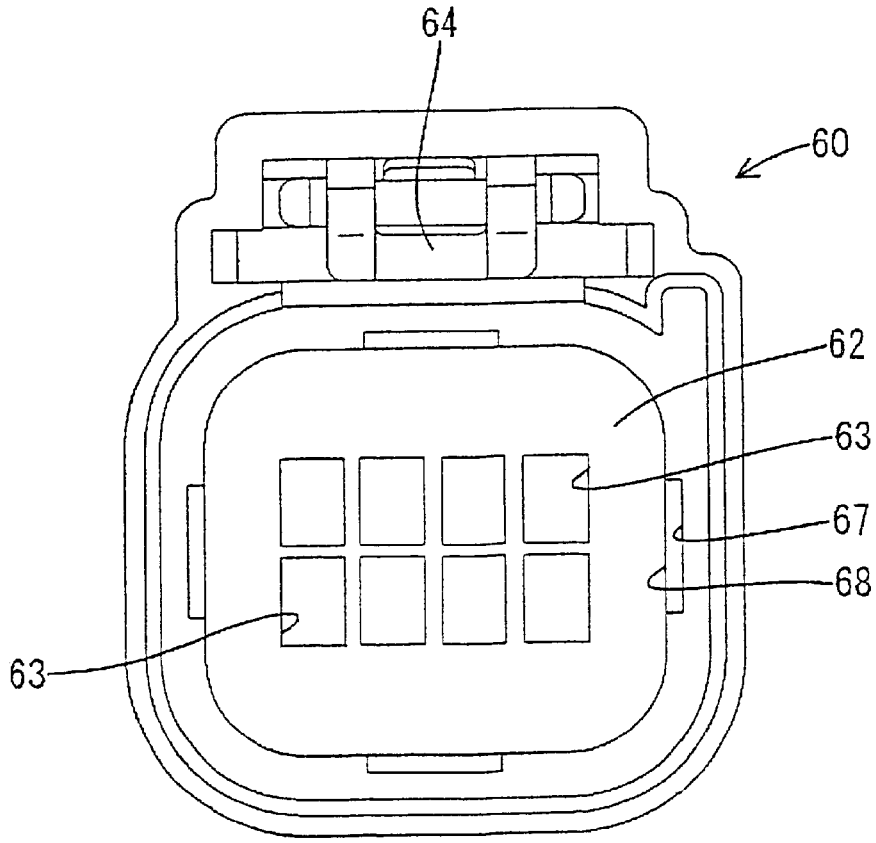
FIG. 13 is a front view of a hood of the present invention.
Figure 14:
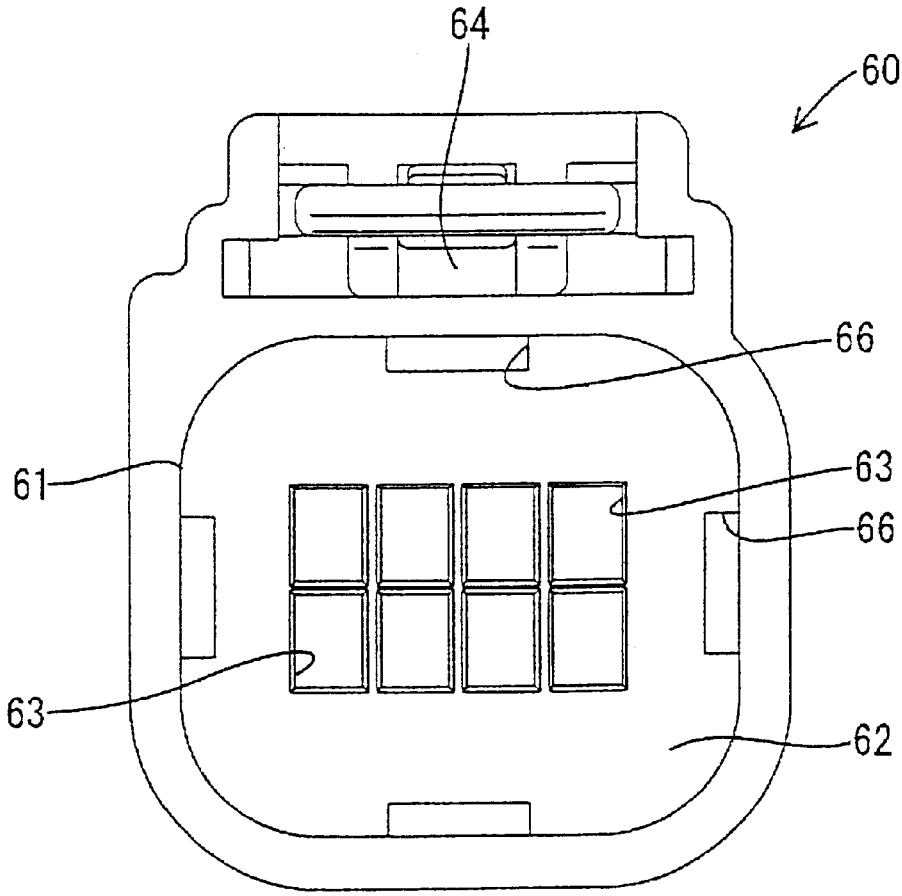
FIG. 14 is a rear view of the hood of FIG. 13.

The fitting position 35 of the packing 34 which seals between female housing 20 and the corresponding male housing (not illustrated) is positioned at the outer periphery in front of the step between the larger and smaller portions of the housing 20. The retainer 40 is configured to be mounted in front of the fitting position 35 of the packing 34. The retainer 40 may be formed of any suitable material, such as a synthetic resin material, and is provided with a front stop plate 41 which covers the front face of the front end part of the housing 20, a side plate 42 which covers the left side face as viewed from the front, and an upper face plate 43A and a lower face plate 43B which cover the top and bottom faces as shown in FIGS. 1, 11 and 12. The front stop plate 41 functions to stop the female terminal fittings 10 inserted in the chambers 21 from extending out of the front ends of the chambers, while insertion openings 44 through which the tabs of the male terminal fittings may be inserted open at positions corresponding to the respective chambers 21.

A ceiling wall plate 45A and a bottom wall plate 45B, respectively constitute the front end part of the ceiling wall of the upper level chambers 21 and the front end part of the bottom wall of the lower level chambers 21. They are located a fixed distance from the upper face plate 43A and the lower face plate 43B and extend from the rear face of the front stop plate 41. Four projections 46 are formed at positions corresponding to the positions of the terminal insertion openings 44 at the midpoint of the inside face side of the ceiling wall plate 45A and the bottom wall plate 45B. The respective projections 46 can penetrate into the hooked grooves 16 of the female terminal fittings 10 from the side.

Retainer insertion holes 26, in which the above-mentioned retainer 40 is inserted, are formed at the front face of the housing 20. The retainer insertion holes 26 have top and bottom insertion grooves 27 which respectively receive the ceiling wall plate 45A and the bottom wall plate 45B of the retainer 40. The projection insertion grooves 28 can respectively receive the projections 46, and are formed in the lower face of the upper side insertion groove 27 and the upper face of the lower side insertion groove 27. Specifically, the respective projection insertion grooves 28 correspond to the configurations of the ceiling face of the upper level chambers 21 and the bottom face of the lower level chambers 21, namely, positions corresponding to the hooked grooves 16 when the female side terminal fittings 10 are properly inserted.

Figure 5:
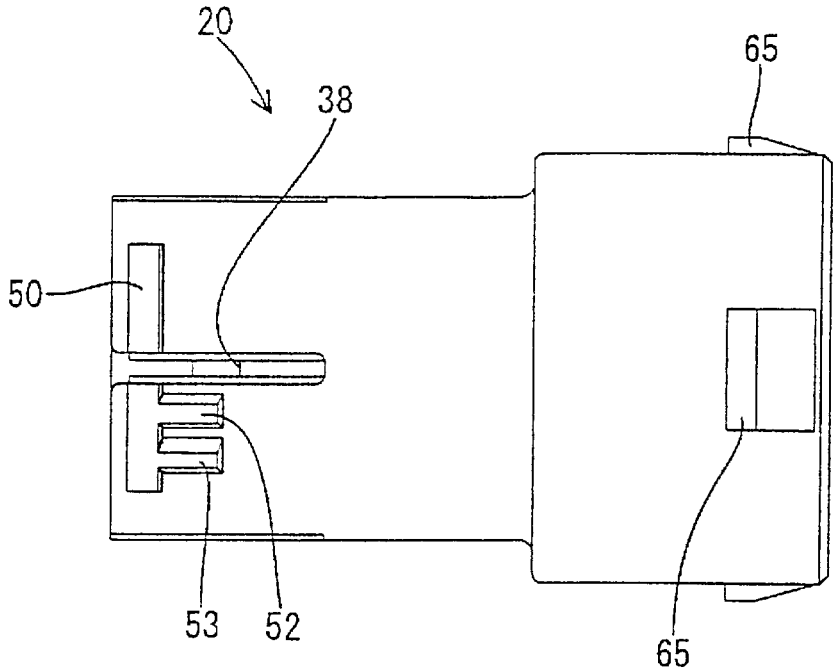
FIG. 5 is a plan view of the housing of FIG. 4.
Figure 6:
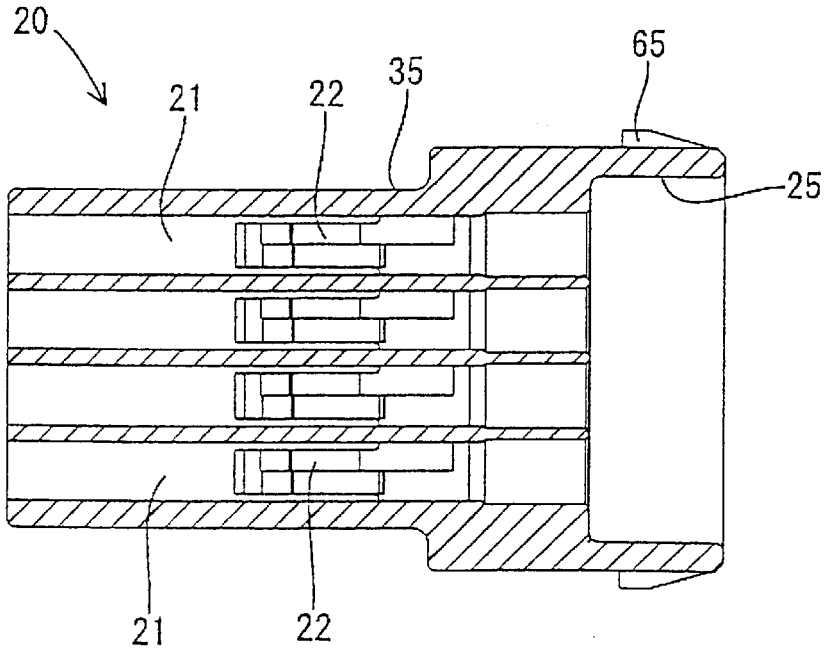
FIG. 6 is a sectional plan view of the housing of FIG. 4.
Figure 7:
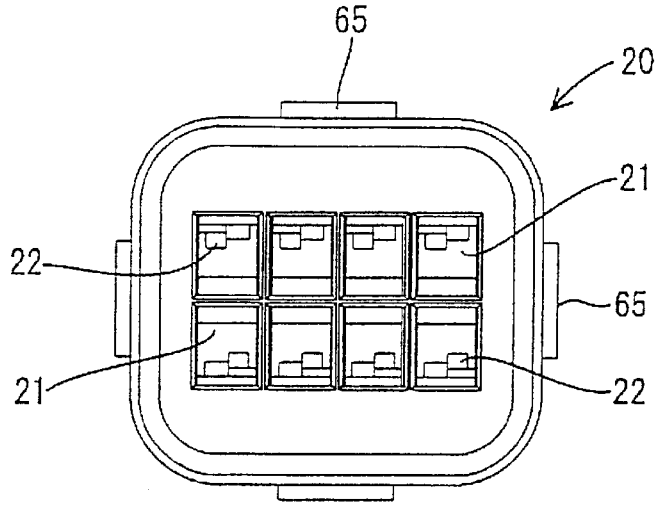
FIG. 7 is a rear view of the housing of FIG. 4.
Figure 8:
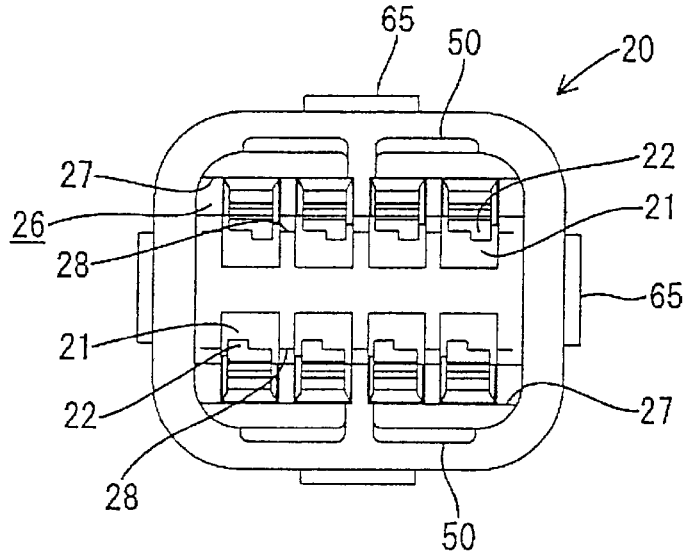
FIG. 8 is a front view of the housing of FIG. 4.

As shown in FIG. 5, ribs 50 extending in the transverse direction are formed on the upper face and the lower face at the front end of the housing 20. As shown in FIG. 1, guide grooves 51 which receive the ribs 50 also extend in the transverse direction and are formed at the innermost position of retainer 40.

Accordingly, the retainer 40 maintains the front stop plate 41 along the front face of the housing 20, while the ceiling wall plate 45A and the bottom wall plate 45B pass through insertion grooves 27. The retainer 40 is configured to be inserted and mounted from the left side face as viewed from the front of the housing 20 (note FIG. 12), while the ribs 50 pass through the guide grooves 51. At this time, the projections 46 of the retainer 40 are inserted and passed through the projection insertion grooves 28.

Figure 9:
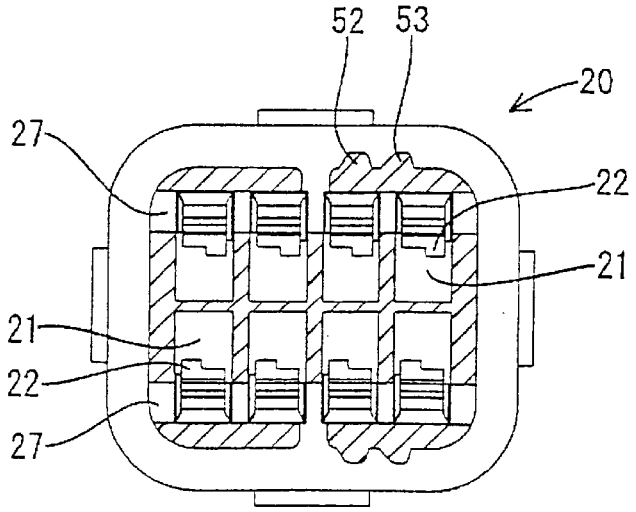
FIG. 9 is a sectional front view of the housing of FIG. 4.

As shown in FIG. 5 and FIG. 9, temporary locking protrusion strips 52 and final locking protrusion strips 53 are provided on the upper face and the lower face of the housing 20 on the inside of the ribs 50 toward the right side as viewed from the front. On the other hand, the locking grooves 54 to which the above-mentioned temporary locking protrusion strips 52 and the final locking protrusion strips 53 can be fitted are formed at the right side as viewed from the front in the inner face of the upper face plate 43A and the lower face plate 43B of the retainer 40, as shown in FIG. 12. Further, escape grooves 55 which fit the temporary locking protrusion strips 52 and the final locking protrusion strips 53 to allow for escape are formed at both sides of the locking grooves 54.

Figure 20:
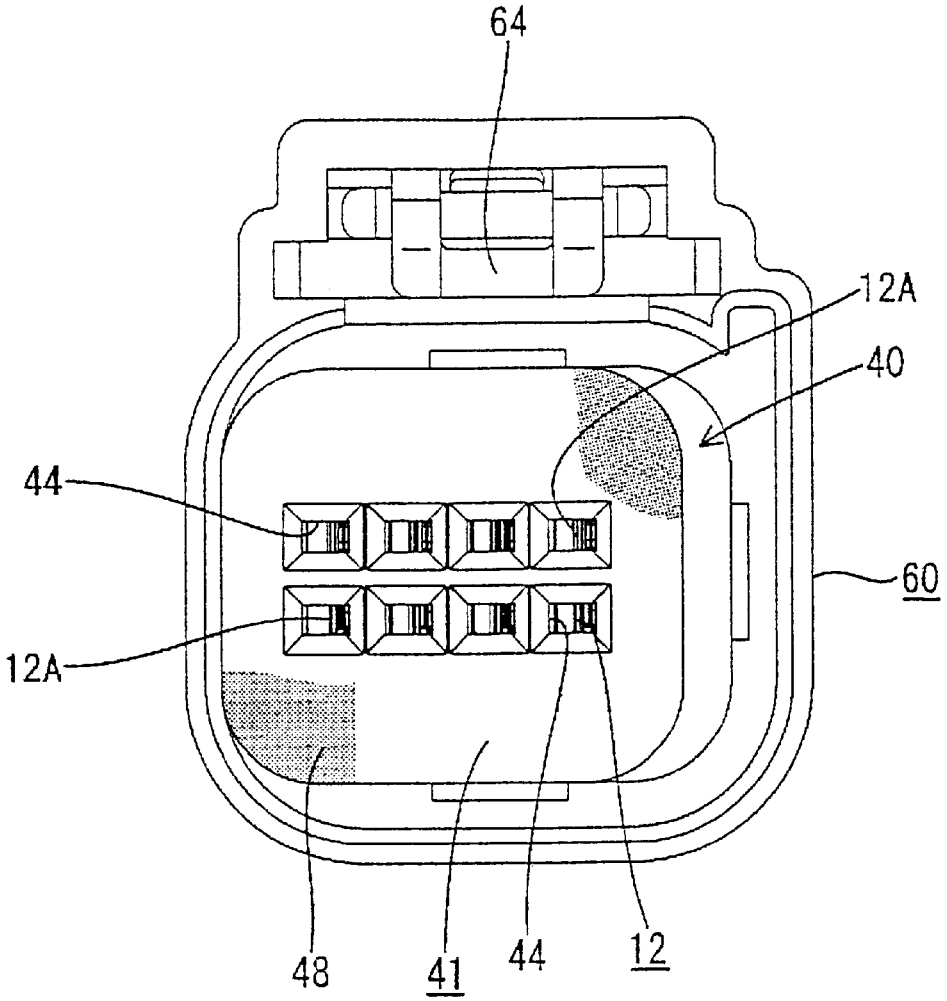
FIG. 20 is a front view of a retainer situated at a temporary locking position.

When the retainer 40 is inserted in the retainer insertion hole 26, the temporary locking protrusion strips 52 are first fitted in the locking grooves 54, and retained at the temporary locking position, as shown in FIG. 20. When the retainer 40 is situated at the temporary locking position, each terminal insertion opening 44 of the front stop plate 41 is offset to the left side as shown in FIG. 20, and only the left side region of the front face of the corresponding chamber 21 is open. Further, the respective projections 46 are in a condition in which they are to the left side of the corresponding chambers 21.

Figure 21:
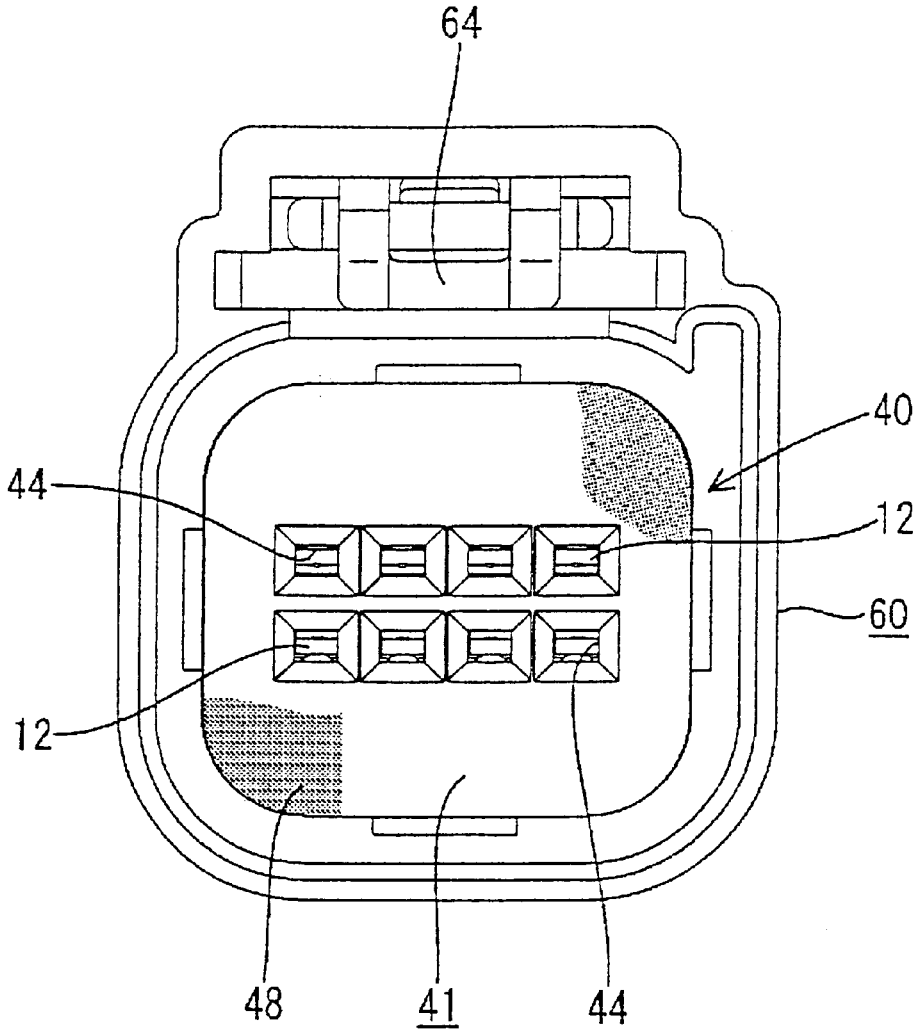
FIG. 21 is a front view of a retainer situated at a final locking position.

Further, when the retainer 40 is pushed in from the temporary locking position to the final locking position, the final locking protrusion strips 53 are fitted in the locking groove 54, as shown in FIG. 21. In the final locking position, the left side plate 42 of the retainer 40 is in substantially the same plane as the left side face of the rear end part of the housing 20. Further, each terminal insertion opening 44 of the front stop plate 41 aligns with the front face of the corresponding chamber 21, and each of the projections 46 penetrates into the corresponding chamber 21.

Further, as shown in FIG. 11, a wrinkled face 48 is formed on the surface of the front stop plate 41 of the retainer 40. The wrinkled face 48 indicates an uneven rough face. The wrinkled face 48 is formed, for example, by forming a wrinkled pattern on the molding face of a mold on which the surface of the front stop plate 41 is molded, in the mold for the retainer 40.

The hood 60 is made of any suitable material, such as synthetic resin, formed in a square tubular form which covers the housing 20. A smaller diameter part 61 which snugly covers the outer periphery of the rear end part of the housing 20 is formed at the rear end part of the hood 60. A rear stop plate 62 extends across the rear face of the smaller diameter part 61. Window holes 63 through which the female terminal fittings may pass are formed in the rear stop plate 62 in correspondence with chambers 21.

Further, a locking arm 64 for locking with a corresponding male housing in a fitted condition is provided at a central position of an upper portion of the hood 60.

Hooking projections 65 are provided at the rear rims of the four faces of the housing 20 at central portions thereof. The rear side of the respective hooking projections 65 is tapered.

Hooking grooves 66 in which the hooking projections 65 can be fitted are formed in the walls of the hood 60 at positions corresponding to the four faces of the housing 20. When the rear of the housing 20 is fitted in the smaller diameter part 61 until it hits against the rear stop plate 62, the hooking projections 65 are fitted on the hooking grooves 66. Further, shallow escape grooves 67 are formed at the front side of the hooking grooves 66, and a tapered part 68 extends between them.

The present mode of operation is described below. As an example of the procedure of assembly, the packing 34 is first fitted at the fitting position 35 on the housing 20, and a collective stopper 30 is fitted in the stopper storing recess 25. Then, the retainer 40 is inserted in the retainer insertion hole 26 from the left side as viewed from the front, and assembled at the temporary locking position. In this condition, only the left half region of the front face of the chambers 21 is opened through each of terminal insertion openings 44 of the front stop plate 41 of the retainer 40, and the projections 46 are to the left side of the corresponding chambers 21. The retainer 40 also functions as a removal-stopper for the packing 34.

Figure 15:
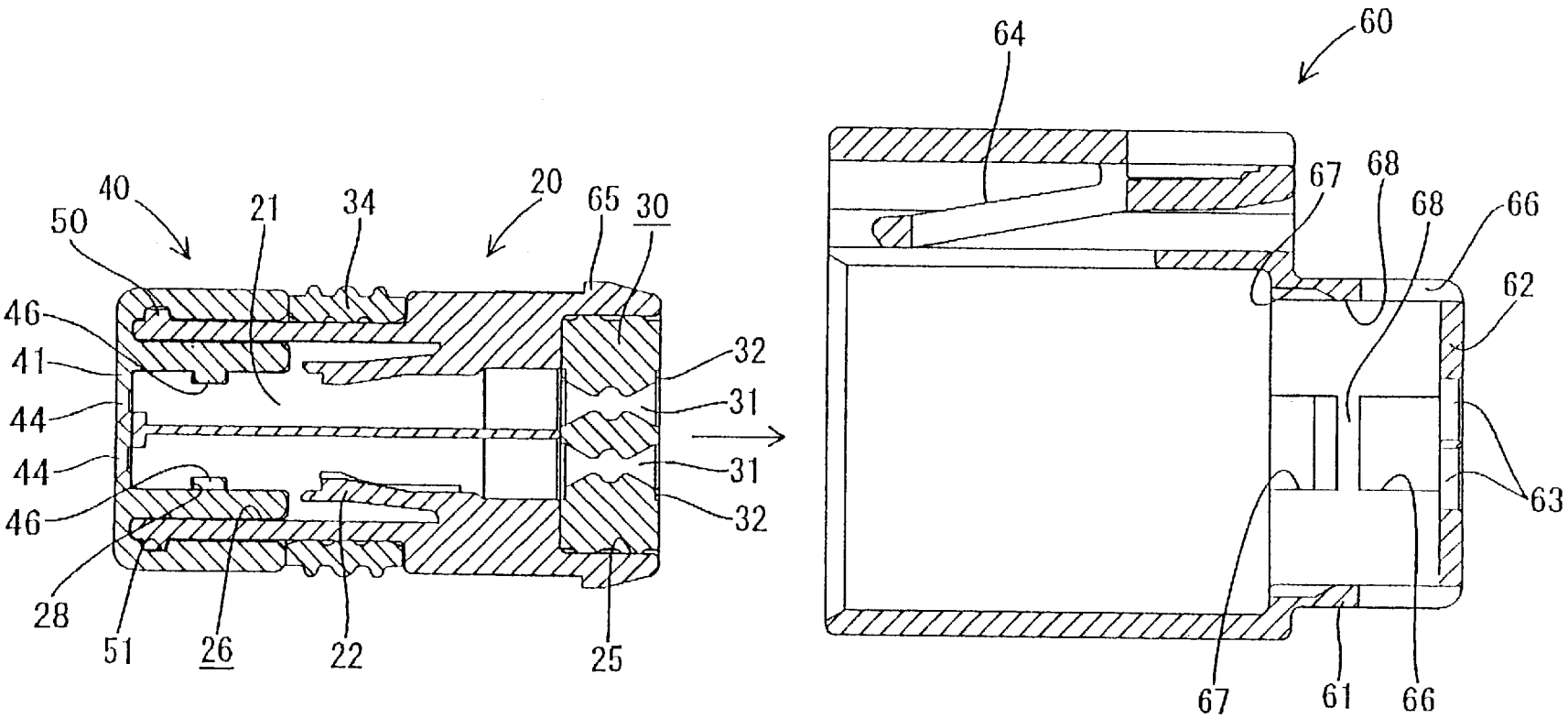
FIG. 15 is a sectional side view prior to assembly of a housing with a hood.
Figure 16:
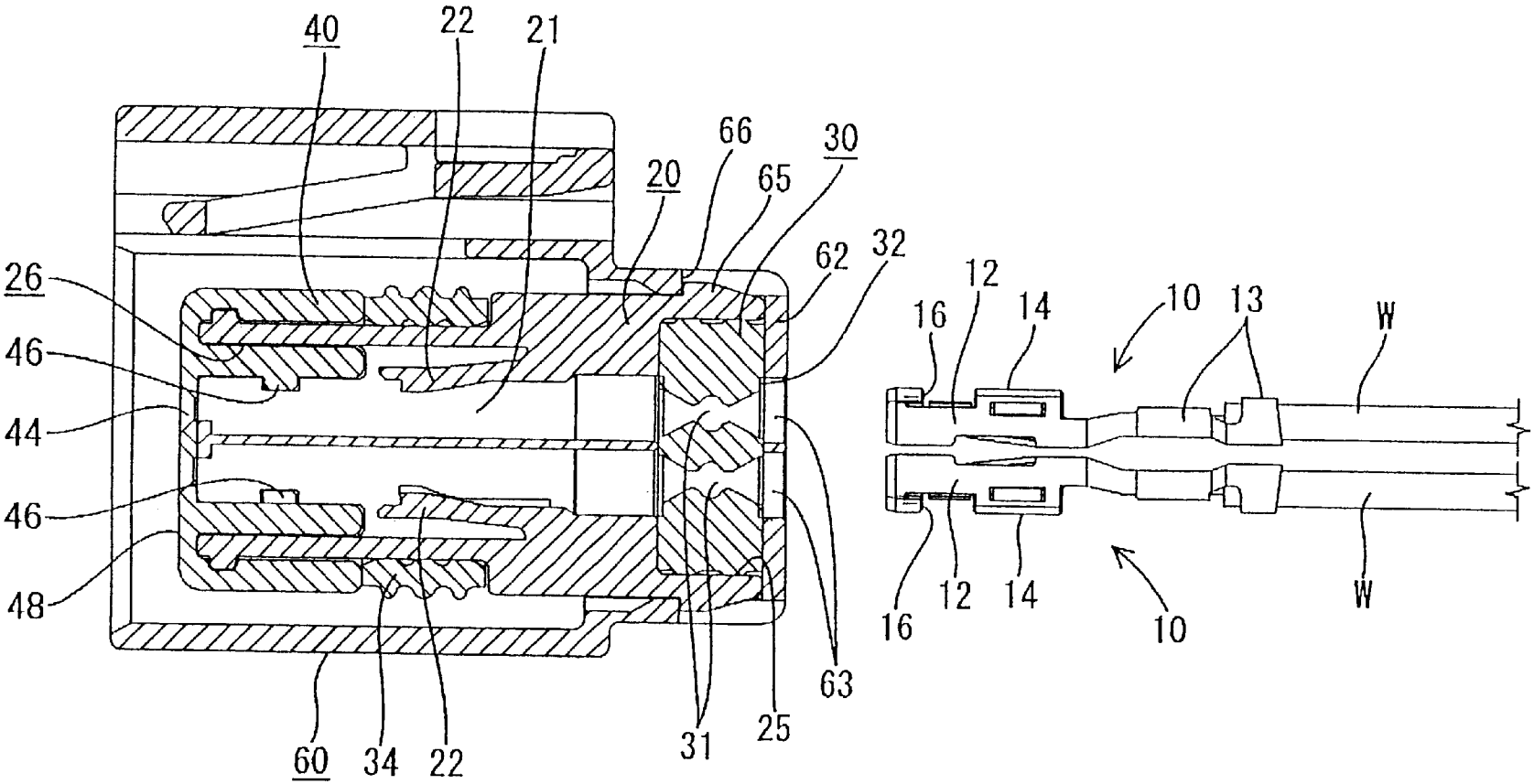
FIG. 16 is a sectional side view prior to insertion of female terminal fittings.
Figure 17:
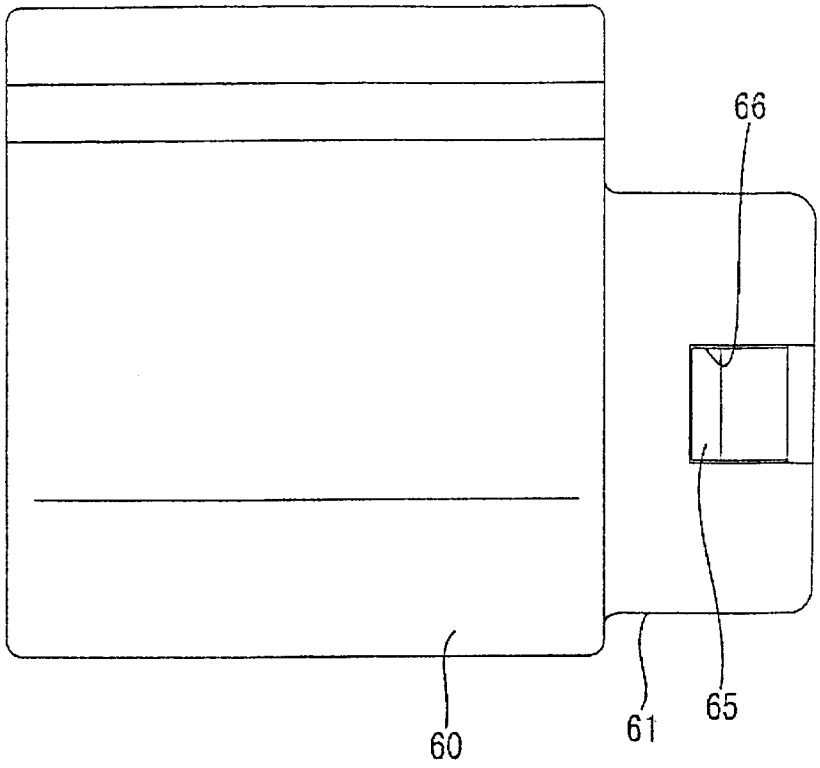
FIG. 17 is a side view of a housing inserted in a hood.

When the packing 34 and the stopper 30 are mounted against the housing 20 as described above and the retainer 40 is assembled at the temporary locking position, the rear end part of the housing 20 is inserted in the hood 60 from the front as shown in FIG. 15. The hooking projections 65 are pushed in while transversing along the escape grooves 67 and the rear end face is pushed in until it hits against the rear stop plate 62 of the hood 60. Each of the hooking projections 65 passes over the tapered part 68, is fitted in the hooking grooves 66 as shown in FIG. 16 and FIG. 17, and the housing 20 and the hood 60 are assembled. Additionally, the stopper 30 is retained in position by the rear stop plate 62. The assembly may be delivered to a location for the terminal insertion in such condition.

As shown in FIG. 16, the female terminal fittings 10 are provided in a position in which they face in opposite up and down directions for terminal insertion, and are inserted in the corresponding chambers 21 through the window holes 63 of the rear stop plate 62. Specifically, the female side terminal fittings 10 of the upper level are inserted in a position in which the stabilizers 14 are to the upper right as viewed from the insertion direction, and the stabilizers of those in the lower level are in a position to the lower left as viewed from the insertion direction.

Figure 18:
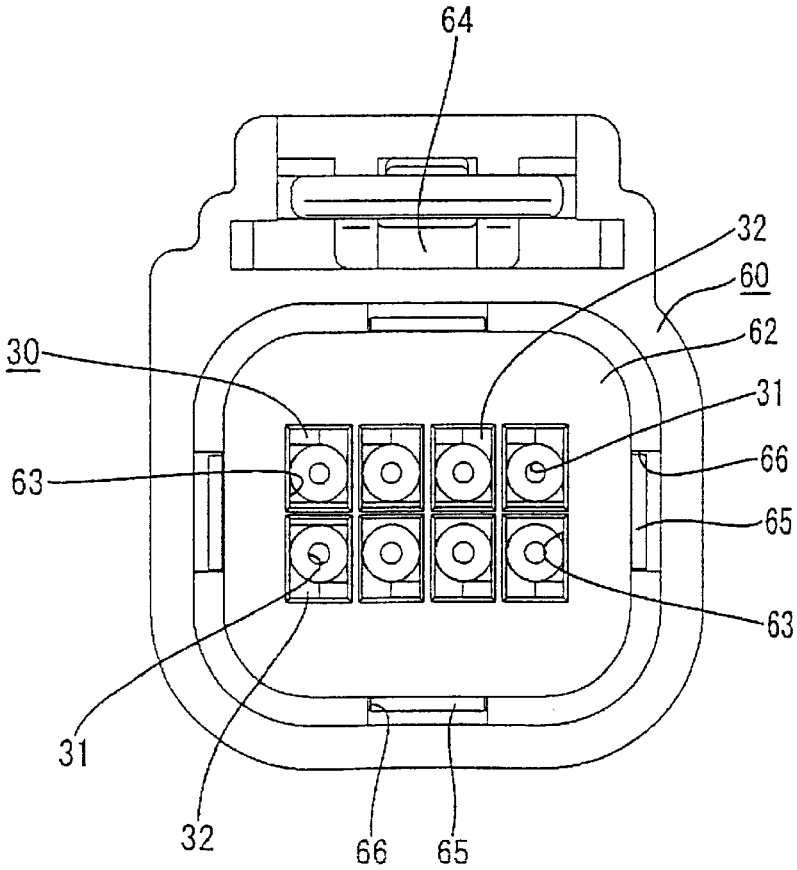
FIG. 18 is a rear view of the housing inserted in the hood of FIG. 17.

As shown in FIG. 18, the marks 32 provided at the entrance rim of the electric wire insertion holes 31 can be viewed through the window holes 63 of the rear stop plate 62. Since the marks 32 are marked at the upper right position for the upper level electric wire insertion holes 31 and the marks 32 are marked at the lower left position for the lower level electric wire insertion holes 31, the female terminal fittings 10 can be inserted in the proper position by positioning the stabilizers 14 in alignment with the marks 32.

Figure 19:
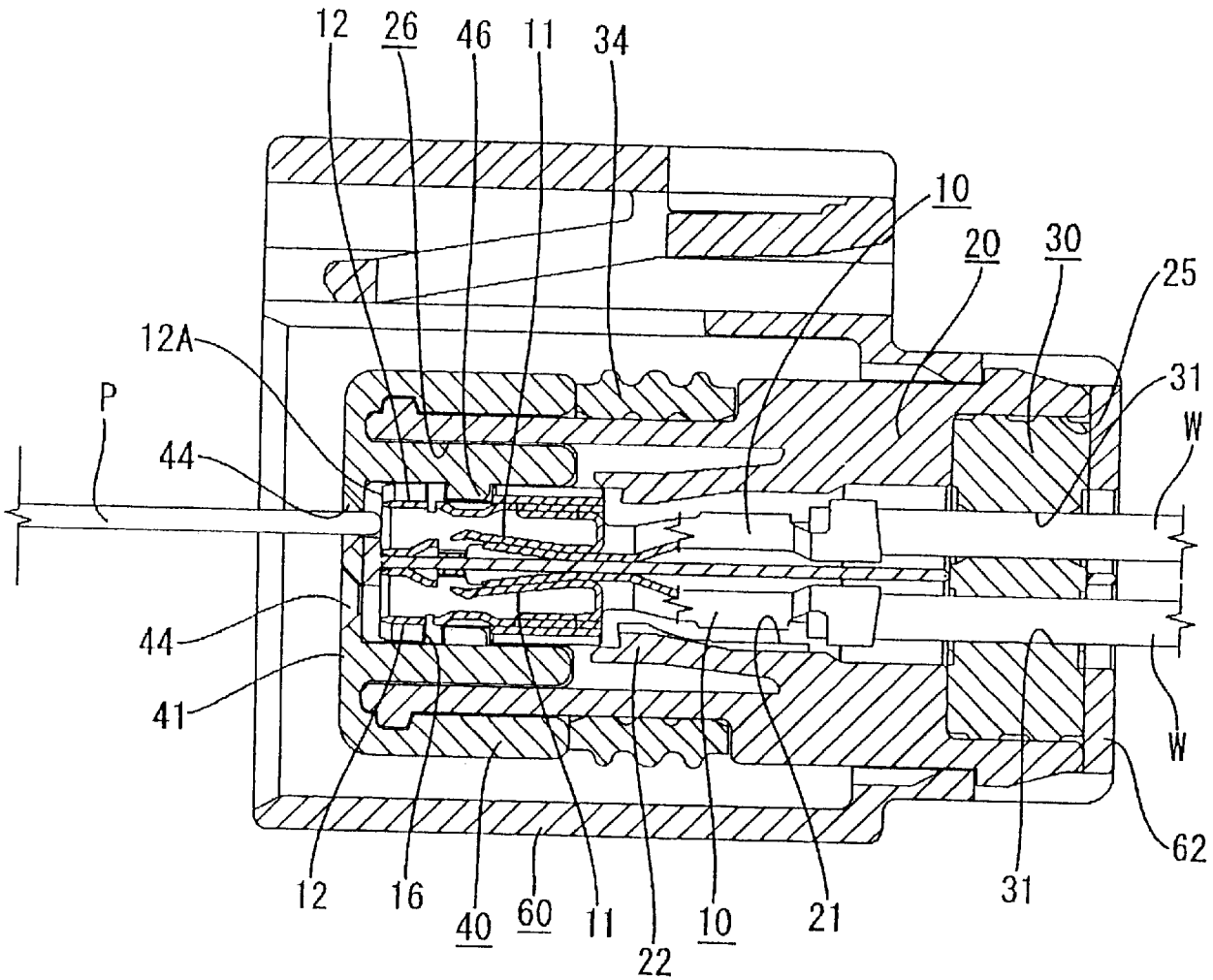
FIG. 19 is a sectional side view showing performance of a continuity test.

The female terminal fittings 10 are pushed in through the window holes 63 while spreading the electric wire insertion holes 31 of the stopper 30, and inserted in the corresponding chambers 21. They are pushed in while bending the lances 22 toward the bending space 23, and without being obstructed by the projections 46 of the retainer 40. When they are inserted in the proper position, the lances 22 return to their original positions, and are hooked on the barb portions 15 as shown in FIG. 19. Further, the inner peripheral face of the electric wire insertion holes 31 of the stoppers 30 grip the outer peripheral face of the electric wires W which were inserted.

When the insertion of the female terminal fittings 10 in the chambers 21 is complete, the continuity test for whether the respective female terminal fittings 10 are inserted in the proper chambers 21 is carried out. The continuity test is carried out while the retainer 40 is locked in the temporary locking position by contacting the test probe P of the testing equipment against the female terminal fittings 10 through the terminal insertion openings 44 of the front stop plate 41 of the retainer 40 as shown in FIG. 19.

Figure 3:
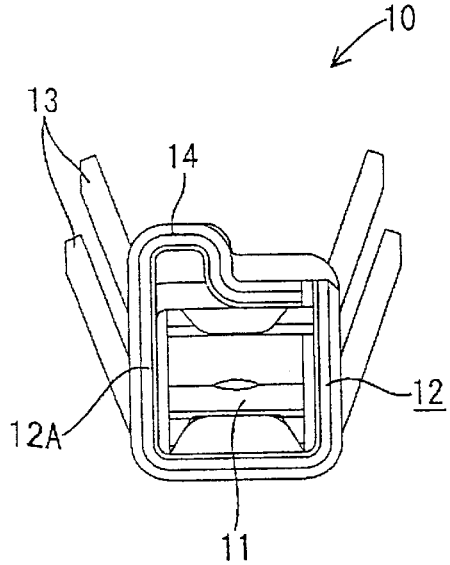
FIG. 3 is a front view of the female terminal fitting of FIG. 2.
Figure 4:
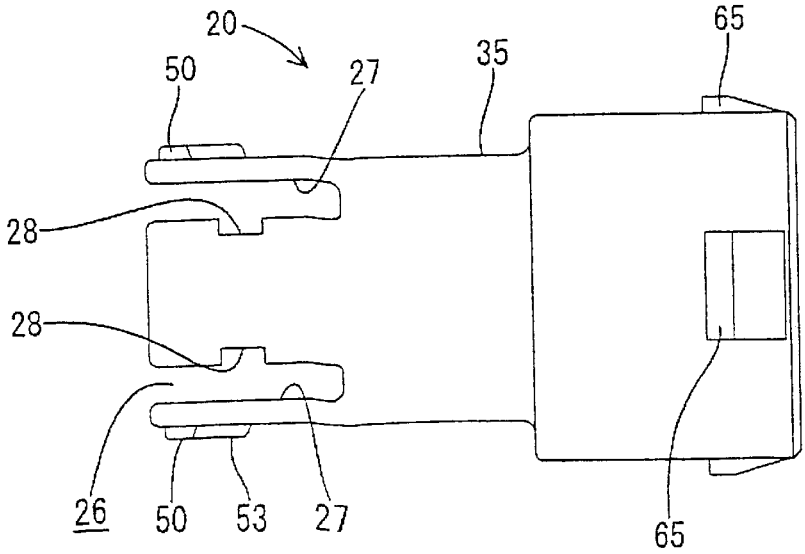
FIG. 4 is a side view of a female terminal housing of the present invention.

As shown in FIG. 20, when the retainer 40 is in the temporary locking position, the terminal insertion openings 44 of the front stop plate 41 are offset to the left side, and only the left side region of the front face of the corresponding chambers 21 is in an opened condition. Therefore, the test probe P passed through the terminal insertion openings contacts the left side rim portion of the front of the connecting parts 12 of the female terminal fittings 10. Further, as shown in FIG. 3, in the upper level female terminal fittings 10, the rim side 12A is the rim side of the side on which the stabilizers 14 are provided, and in the lower level female terminal fittings 10, the rim side 12A is the rim side opposite the side on which the stabilizers 14 are provided. Accordingly, the test probe P is prevented from passing deeply into the connecting parts 12 and excessively bending the connecting pieces 11.

After the continuity test is complete, the connector is taken out from the test equipment and, the retainer 40 is moved to the final locking position. Specifically, a member, such as an operator's finger, engages the surface of the front stop plate 41 of the retainer 40, and the retainer 40 is moved to the right from the condition of FIG. 20. When the retainer 40 is moved to the final locking position as shown in FIG. 21, the final locking protrusion strips 53 are fitted in the locking groove 54 as described above, and retained in the final locking position. When the final locking protrusion strips 53 pass from the escape grooves 55 to the locking groove 54, they encounter resistance, but since the wrinkled face 48 is formed on the surface of the front stop plate 41, finger slipping is suppressed and the retainer 40 can be smoothly moved.

When the retainer 40 is moved to the final locking position, the projections 46 of the retainer 40 penetrate into the chambers 21, and are fitted in the hooked grooves 16 of the female terminal fittings 10 from the side. The female terminal fittings 10 are thus doubly locked in a no-slip condition. Further, the terminal insertion openings 44 of the front stop plate 41 are placed in a condition in which they are concentrically coordinated.

According to the above description, the assembly of the female waterproof connector in which the inlet side of the respective chambers 21 is sealed by the stopper 30 is completed. Further, when fitted with the male connector, the female and male terminal fittings are mutually connected, the packing 34 is sandwiched between the female side housing 20 and the corresponding male side housing, and the gap between both housings is sealed.

As illustrated above, according to the present mode of operation, the continuity test is designed to be carried out by inserting the test probe P through the terminal insertion openings 44 of the front stop plate 41 of the retainer 40 in a condition in which the retainer 40 is situated at the temporary locked position. When the retainer 40 is situated at the temporary locked position, the terminal insertion openings 44 are offset from the front of the chambers 21. Since only a portion of the front rims of the connecting parts 12 of the female terminal fittings 10 inserted in the chambers 21 faces the terminal insertion openings 44, the test probe P hits against such portion of the front rims of the connecting parts 12 when inserted in the terminal insertion openings 44, and is prevented from deeply entering into the connecting parts 12. As a result, the connecting pieces 12 are prevented from being excessively bent and damaged.

The present invention is not limited to the embodiment illustrated according to the above-mentioned description and drawings. For example, the following alternatives are also contemplated, and various other changes can also be carried out within the scope of the present invention.

In the above-mentioned embodiment, the temporary locking position of the retainer corresponds to the test position, but the test position may be provided separately between the temporary locking position and the final locking position.

The test probe insertion openings may also be provided separately from the terminal insertion openings.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2000-401686 filed on Dec. 28, 2000, the disclosure of which is herein expressly incorporated by reference it its entirety.

What is claimed:

1. A connector for accommodating female terminal fittings having tubular portions configured to receive tabs of corresponding male terminal fittings, said connector comprising:

a connector housing including a plurality of chambers therein, each chamber configured to receive a female terminal fitting inserted therein from a rear end thereof; and a retainer configured to be inserted in a front end of said connector housing, said retainer being formed with a front stop plate and including locking portions configured to engage female terminal fittings inserted in the chambers for retaining the female terminal fittings therein, the front stop plate being configured to cover front ends of the chambers, wherein the front stop plate is configured to be locked in a test position in which openings in the front stop plate are aligned with portions of front edges of the female terminal fittings inserted in the chambers, so that a test probe inserted through a front stop plate opening will contact a portion of a front edge of a female terminal fitting.

2. The connector of claim 1, wherein the locking portions of the retainer do not engage the female terminal fittings inserted in the chambers when the front stop plate is locked in the test position.

3. The connector of claim 2, wherein the front stop plate is configured to be locked in a final position in which the openings in the front stop plate are aligned with the chambers so that a tab of a male terminal fitting inserted through a front stop plate opening will be received in the tubular portion of a female terminal fitting inserted in a chamber.

4. The connector of claim 3, wherein the locking portions of the retainer engage the female terminal fittings inserted in the chambers when the front stop plate is locked in the final position.

5. A method for using a connector and testing for proper insertion of female terminal fittings in chambers of a connector housing, the female terminal fittings having tubular portions configured to receive tabs of corresponding male terminal fittings therein, the method comprising:

inserting a retainer formed with a front stop plate in a front end of the connector housing so that the front stop plate of the retainer covers front ends of the connector housing chambers;

locking the front stop plate in a test position in which openings in the front stop plate are aligned with portions of front edges of the female terminal fittings inserted in the connector housing chambers; and inserting a test probe through a front stop plate opening, whereby the test probe contacts a portion of a front edge of a female terminal fitting inserted in a connector housing chamber while being prevented from entering the tubular portion of the female terminal fitting.

6. The method of claim 5, further comprising:

moving the front stop plate from the test position to a final position in which the openings in the front stop plate are aligned with the connector housing chambers; and inserting a tab of a male terminal fitting through a front stop plate opening whereby the tab of the male terminal fitting enters the tubular portion of a female terminal fitting inserted in a connector housing chamber.

7. The method of claim 6, wherein the retainer includes locking portions configured to engage female terminal fittings inserted in the connector housing chambers to retain the female terminal fittings therein, the locking portions not engaging the female terminal fittings while the front stop plate is locked in the test position, further comprising:

locking the female terminal fittings in the connector housing chambers by engaging the female terminal fittings with the locking portions of the retainer when the front stop plate is moved to the final position.

8. The method of claim 5, further comprising:

inserting female terminal fittings into the chambers of the connector housing and removing female terminal fittings from the chambers of the connector housing after the retainer has been inserted in the front end of the connector housing, while the front stop plate is locked in the test position.

9. A connector comprising:

a connector housing having at least one chamber passing through;

a retainer configured to be inserted in a front end of said connector housing, said retainer being formed with a front stop plate having at least one insertion opening passing therethrough; and locking members on the connector housing and the retainer for locking the front stop plate in both a temporary position in which the at least one insertion opening of the front stop plate is partially offset from the at least one chamber of said connector housing, and a final position in which the at least on insertion opening of the front stop plate is aligned with the at least one chamber of said connector housing.

10. The connector of claim 9, wherein said connector housing includes a plurality of chambers passing therethrough, and the front stop plate includes a plurality of insertion openings passing therethrough.

11. The connector of claim 9, wherein said retainer further comprises at least one locking portion configured to engage a terminal fitting inserted in the at least one chamber of said connector housing to retain the terminal fitting therein.

12. The connector of claim 11, wherein said connector housing includes a plurality of chambers passing therethrough, and the front stop plate includes a plurality of insertion openings passing therethrough.

13. The connector of claim 11, wherein the at least one locking portion of the retainer engages a terminal fitting in the at least one chamber of said connector housing when the front stop plate is locked in the final position, and the at least on locking portion of the retainer do not engage the terminal fitting in the at least one chamber of said connector housing when the front stop plate is locked in the temporary position.

14. The connector of claim 13, wherein said connector housing includes a plurality of chambers passing therethrough, and the front stop plate includes a plurality of insertion openings passing therethrough.

15. The connector of claim 9, wherein the at least one chamber of said connector housing is configured to receive a female terminal fitting inserted therein, and the at least one insertion opening of the front stop plate is configured to permit passage of a test probe therethrough for contacting a female terminal fitting when the front stop plate is locked in the temporary position, and to permit passage of a male terminal fitting therethrough for connection with the female terminal fitting when the front stop plate is locked in the final position.

16. The connector of claim 15, wherein said connector housing includes a plurality of chambers passing therethrough, and the front stop plate includes a plurality of insertion openings passing therethrough.

* * * * *

UNITED STATES PATENT AND TRADEMARK OFFICE

CERTIFICATE OF CORRECTION

PATENT NO. : 6,626,702 B2
DATED : September 30, 2003
INVENTOR(S) : N. Kurimoto et al.

It is certified that error appears in the above-identified patent and that said Letters Patent is hereby corrected as shown below:

Column 10,
Line 24, “through” should be -- therethrough --.
Line 34, “on” should be -- one --.
Line 54, “on” should be -- one --.

Signed and Sealed this

Second Day of March, 2004

JON W. DUDAS
*Acting Director of the United States Patent and Trademark Office*